US005906084A

United States Patent [19]

Millington et al.

[11] Patent Number: 5,906,084

[45] Date of Patent: May 25, 1999

[54] MODULAR DECKING SYSTEM

[75] Inventors: Gary James Millington, Hackham; Franek Savarton, Yundi Via Willunga, both of Australia

[73] Assignee: Ecoform Pty Ltd, South Australia, Australia

[21] Appl. No.: 08/994,854

[22] Filed: Dec. 19, 1997

[30] Foreign Application Priority Data

Dec. 20, 1996 [AU] Australia ..... PO 4322

[51] Int. Cl.[6] ..... E04H 12/00

[52] U.S. Cl. ..... 52/650.3; 52/263; 14/73.5

[58] Field of Search ..... 57/263, 650.3; 403/90, 92; 14/73, 73.5, 75

[56] References Cited

U.S. PATENT DOCUMENTS 2,680,259 6/1954 Milk ..... 14/73.5
5,623,803 4/1997 Willis ..... 52/650.3

FOREIGN PATENT DOCUMENTS 2223783 4/1990 United Kingdom ..... 14/73.5

*Primary Examiner*—Creighton Smith
*Attorney, Agent, or Firm*—McCormick, Paulding & Huber

[57] ABSTRACT

An improved modular decking system, the system including decking in the form of a plurality of treads, the decking being carried by one or more bearer members and the bearer members in turn being supported at or above ground level by one or more stumps. The decking system is such that engagement between bearer members and stumps is via a bearer locating system which includes a pivotable locating member providing a free coupling between a bearer member and its supporting stump. The decking system may include a tread locating system for engagement of bearer members with treads, the tread locating system including a locating pin suitable to locate the tread on the bearer member in a predetermined position, The decking system may also include a tread interlocking system for engagement of adjacent treads, the tread interlocking system including respective male and female members on adjacent treads to mate the adjacent treads.

14 Claims, 6 Drawing Sheets

MODULAR DECKING SYSTEM

FIELD OF THE INVENTION

The present invention relates to a modular decking system of the type that may be used for paths, boardwalks, platforms, decking, jetties, piers, verandahs, and small crossings such as pedestrian bridges, or the like.

It is envisaged that the modular decking system of the present invention will find particular use as boardwalks through environmentally sensitive areas such as wetlands and rainforests.

BACKGROUND OF THE INVENTION

Most available decking systems require the use of heavy equipment for their in situ construction, and also require the preparation of substantial foundations or footings. In most situations, and certainly in environmentally sensitive situations, these requirements cause significant damage to the surrounding areas.

Additionally, many areas in which such decking systems are required are irregular in terms of terrain, and introduce planning difficulties where a flat surface is required over undulating features. In particular, laying paths, tracks or boardwalks through wetland areas requires careful planning and mapping to ensure the various components of the path are constructed correctly, whilst even a small margin of error can cause significant construction difficulties.

In general, traditional decking systems are subject to much error in such situations, with subsequent wastage of materials and delays in construction.

Furthermore, many of the environments in which such decking is required are quite harsh and will rapidly erode and damage traditional decking materials such as timber and steel. Concrete and cement, which thus become preferred materials, have typically been avoided for such decking systems due to a perception of them being difficult to use due to their weight and inflexibility in connection and securing techniques.

It is an aim of the present invention to provide an improved modular decking system which overcomes, or at least partly alleviates, the abovementioned difficulties.

SUMMARY OF THE INVENTION

The present invention provides an improved modular decking system, the system including decking in the form of a plurality of treads, the decking being carried by one or more bearer members, and the bearer members in turn being supported at or above ground level by one or more stumps, wherein engagement between the bearer members and the stumps is via a bearer locating system which includes a pivotable locating member which provides a free coupling between a bearer member and its supporting stump.

The reference to a free coupling is intended to define a form of engagement between a bearer member and its supporting stump which allows for some degree of adjustment during construction of the decking system. The free coupling is preferably such that the position of the bearer member in relation to the stump may be adjusted during construction, about the stump in a vertical plane and also in a horizontal plane. Preferably, the free coupling also allows for the decking system to be readily dis-assembled without having to undo or unlock any parts.

DESCRIPTION OF THE INVENTION

In a preferred form, the pivotable locating member is generally of a mushroom-type shape, having a semi-spherical head portion and a leg portion extending away from the head portion. In this form, the pivotable locating member may be placed, inverted, in a hole provided in the upper surface of the stump, the hole having a semi-spherical configuration and being sized so as to snugly receive the semi-spherical head portion of the pivotable locating member. The relationship between pivotable locating member and stump is thus preferably of the ball and socket type.

In order to engage with the pivotable locating member and the stump, the bearer membermay thus include a slot or a hole in its lower surface which is capable of receiving the leg portion of the pivotable locating member therein. The slot or hole is preferably of a size larger than the size of the leg portion such that the leg portion is loosely received therein.

By locating the slot or hole in the lower surface of the bearer member near an end of the bearer member, the end of the bearer member may be located upon the stump with the pivotable locating member engaging both bearer member and stump in a manner which allows for the free coupling therebetween referred to above. In this respect, it can be seen that the preferred form of pivotable locating member acts in a manner similar to a ball and socket hip-joint. It will also be seen that the dead weight of the bearer members (and the treads which the bearer carries) ensures the continued location of the bearer member on the stump. Thus it is preferred that the dead weight of the bearer member be reasonably substantial. Therefore, the decking system of the present invention lends itself to the use of concrete materials in order to increase the dead weight of components such as the bearer member and the treads.

The modular decking system of the present invention preferably also includes a tread locating system which provides engagement between the bearer members and the treads carried thereon. The tread locating system preferably includes a locating pin suitable to be received in the upper surface of the bearer member and the lower surface of a tread to locate the tread on the bearer member in a predetermined position. Preferably, the tread locating system also allows for minor lateral and transverse departure from that position, in terms of adjustment during construction.

In this preferred form of the invention, the upper surface of the bearer member preferably has a hole or slot therein which receives one end of a suitable locating pin (which in a preferred form is a cylindrical locating pin having a circular cross section). The lower surface of a tread similarly includes a hole or a slot which is capable of receiving the other end of the locating pin therein. Preferably, the holes or slots in the upper surface of the bearer member and the lower surface of the treads are sized in relation to the locating pin so as to allow some movement of the tread in relation to the bearer member. In this respect, the holes or slots in the upper surface of the bearer member may be replaced by a trench along the full longitudinal extent of the bearer member, again to provide extra flexibility in the location of the treads therealong.

In this form of the invention, the decking system allows for flexibility during construction in that degrees of error in the location and configuration of stumps and bearer members will be accommodated by the ability to readily adjust and locate the treads thereon. Therefore, very close compliance with the irregularity of the terrain over which the decking is used is not required.

The modular decking system of the present invention preferably additionally includes a tread interlocking system which provides engagement between adjacent treads, the tread interlocking system including respective male and female members on adjacent treads to mate the adjacent treads.

In a preferred form, the male and female members are of the tongue and groove type, and are located at or near a lower portion of the tread so as to be, in use, substantially undetectable from above the tread. The male and female members need not be provided along the full length of the tread, but may be provided as a plurality of members spaced apart from each other. Furthermore, a single male member may be provided on one tread which a correspondingly shaped single female member provided at the appropriate position on an adjacent tread.

The male and female members need not be configured such that complete mating is achieved. In this respect, the male member may be slightly oversized so as to act both as a mating member and a spacing member. This arrangement is particularly preferred where the treads are provided as elongate planks and the decking system is a boardwalk or the like, where there is generally a requirement to be able to see through the boardwalk. Thus, in this form, it is preferred that the planks are spaced from each other by a small amount.

In the most preferred form of the invention, a modular decking system is provided which includes the bearer locating system, the tread locating system and the tread interlocking system referred to above. Thus, the present invention provides an improved modular decking system, the system including decking in the form of a plurality of treads, the decking being carried by one or more bearer members, the bearer members in turn being supported at or above ground level by one or more stumps, wherein engagement between bearer members and stumps is via a bearer locating system which includes a pivotable locating member providing a free coupling between a bearer member and its supporting stump, and wherein a tread locating system is provided for engagement of bearer members with treads, the tread locating system including a locating pin suitable to locate the tread on the bearer member in a predetermined position, and wherein a tread interlocking system is provided for engagement of adjacent treads, the tread interlocking system including respective male and female members on adjacent treads to mate the adjacent treads.

The use of a modular decking system in accordance with the present invention, and particularly in accordance with this most preferred form of the present invention, allows for flexibility and adjustment in the construction of any such systems. The possibility of adjustment during construction, which adjustment may be attended to at virtually any stage of the construction process (whether the adjustment be to the engagement between bearer member and stump, bearer member and tread, or between treads), prevents the need for precise dimensions and configurations to be planned before hand. This allows for the decking system to be provided by modular components that are of uniform size and configuration.

By using the preferred concrete material for the components of the modular decking system of the present invention, suitably heavy components may be provided which assist in the locking engagement of the various aspects of the system. Of course, it will be appreciated that any material that is suitably heavy (perhaps due to its density) may be used. It should nonetheless also be appreciated that the use of a heavy material is not essential to the present invention.

Additionally, by utilising stumps with broad bases, the modular decking system of the present invention avoids the need for foundations or footings, although such foundations or footings may be used if preferred. In this respect, it is possible to provide a central aperture completely through a stump (from top to bottom) such that a stake or spike may be used to pin the stump to the ground.

It will be appreciated that the modular decking system of the present invention may be provided in any form, and may be provided to meet any required use. In particular, the treads referred to above may be provided as elongate planks in a traditional form to provide a path such as that commonly referred to as a boardwalk. Alternatively, the treads may be large slabs, for instance square or rectangular slabs, which are closely butted together to provide a continuous pathway. The area covered by such a decking system may be suitable for use as a platform or as a verandah around an existing structure, there being no restriction on the number of stumps utilised nor or on the number of bearers utilised.

In this respect, the stumps may be configured such that their upper surface includes, for example, four or more holes capable of receiving the pivotable locating members referred to above in the free coupling manner discussed. Thus, a single stump may have, for example, four or more bearer members extending away therefrom and being supported thereby.

Furthermore, the decking system of the present invention may be embellished by the use of additional structures as required, such as hand-rails, guard-rails, kick-rails, chairs or seats, pergolahs or covered areas, and the like. Such structures may be integral with, for example, the treads (the treads possibly being adapted to include receiving members), or may merely be secured to the decking system by any known means.

BRIEF DESCRIPTION OF DRAWINGS

The present invention will now be described in relation to a single preferred embodiment thereof. In this respect, it is to be appreciated that the following description of the preferred embodiment does not limit in any way the generality of the above description.

In the drawings.

DETAILED DESCRIPTION OF THE DRAWINGS

Figure 1:
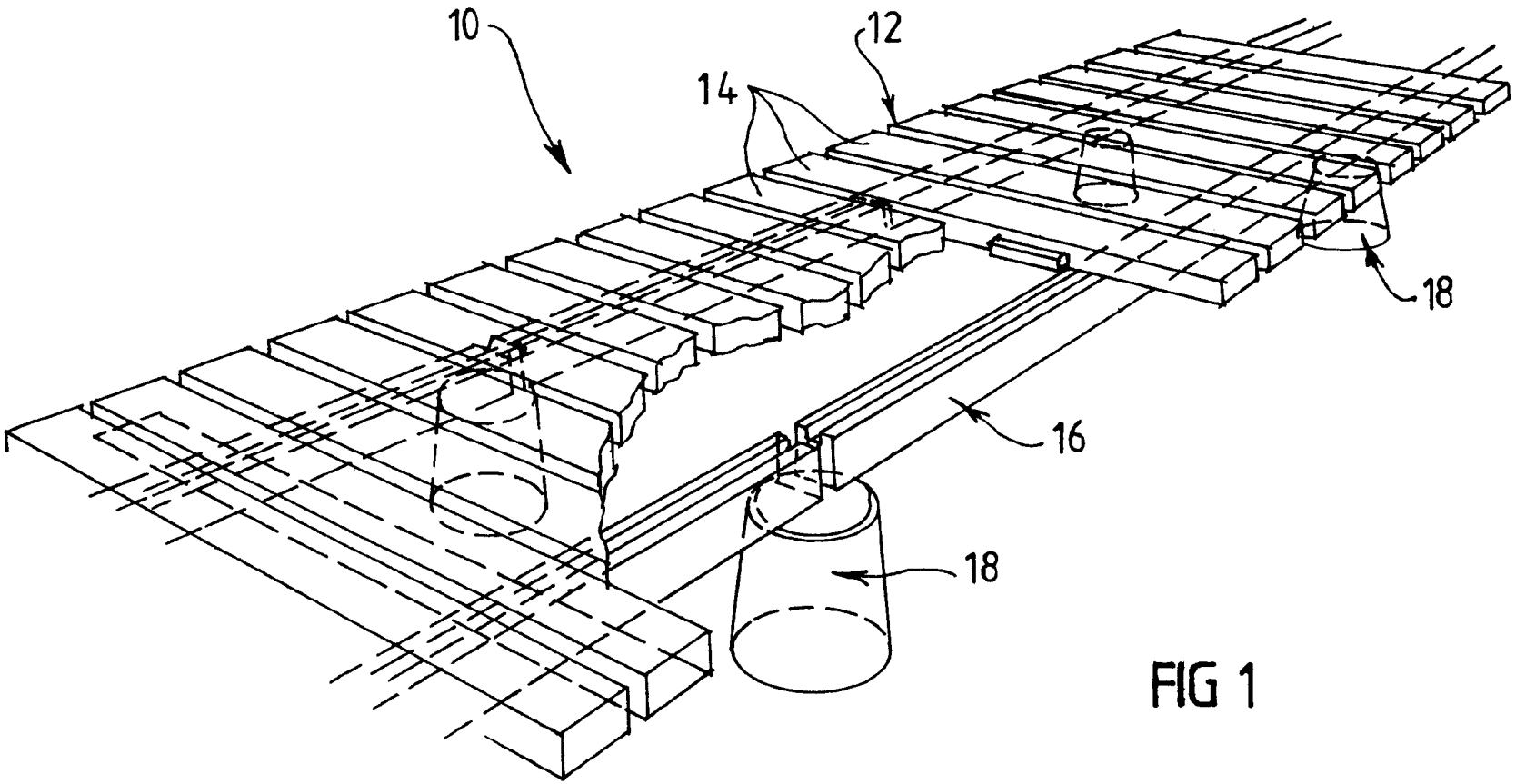
FIG. 1 is a schematic perspective view of a modular decking system in accordance with a preferred embodiment of the present invention.

Illustrated in FIG. 1 is a general view of an improved modular decking system 10 constructed in accordance with the present invention. It will be seen from this illustration that the modular decking system 10 includes a decking 12 in the form a plurality of treads 14 which are carried by bearer members 16, which are in turn supported by stumps 18. The stumps 18 serve to support the bearers 16 a suitable distance above ground level.

As shown in the embodiment, the modular decking system 10 of the present invention may be used to construct a path way such as a boardwalk by utilising a series of spaced apart stumps 18 carrying a series of longitudinally aligned bearers 16 which in turn carry a plurality of treads 14 in the form of elongate planks butted together side-by-side to form a continuous path.

Preferably, each of the three major components of the decking system 10 (namely, the treads 14, the bearers 16 and the stumps 18) are made of concrete. Concrete is a material that is not subject to rapid deterioration as a result of rotting, corrosion or erosion. Additionally, and as will be apparent from the following description, the weight of concrete members is of assistance with the various locating and connecting mechanisms utilised in the decking system of the present invention.

The three major components of the decking system 10 of the present invention will now be described in further detail before turning to a description of the manner of interaction of those three components.

Figure 2A:
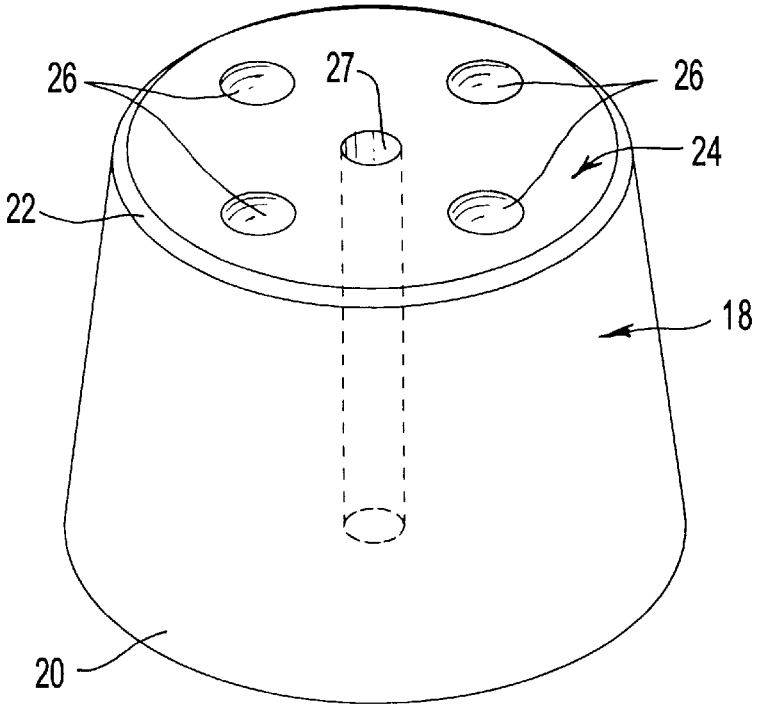
FIG. 2*a* is a perspective view of a stump for use with the embodiment of FIG. 1.

FIG. 2*a* illustrates a preferred configuration of stump 18 for use with the decking system 10 of the present invention. The stump 18 is preferably of a generally frusto-conical form having its base 20 broader than its top 22. In the upper surface 24 there is provided four holes 26 shaped generally such as sockets for use in ball and socket type connections. The sockets shown are substantially semi-spherical to conform with the shape of the head portion of a pivotable locating member to be described below. The stump 18 also includes a centrally located aperture 27 through which a stake may be driven to assist in stabilising the stump 18.

It should be appreciated that a suitable stump for use with the decking system 10 of the present invention may be of any general configuration provided that it allows for the free coupling between a bearer and itself by way of a pivotable locating member. In this respect, an existing pylon, pier or stump may be adapted as necessary to provide the appropriate free coupling. Alternatively, a stump such as that illustrated in FIG. 2*a* may be located upon an existing pylon, pier or stump, duly secured thereto. The stump illustrated in FIG. 2*a* is the preferred form of stump due to its ability to merely be placed upon a surface whilst providing a stable base, and thus without the need to disrupt the surface.

Figure 2B:
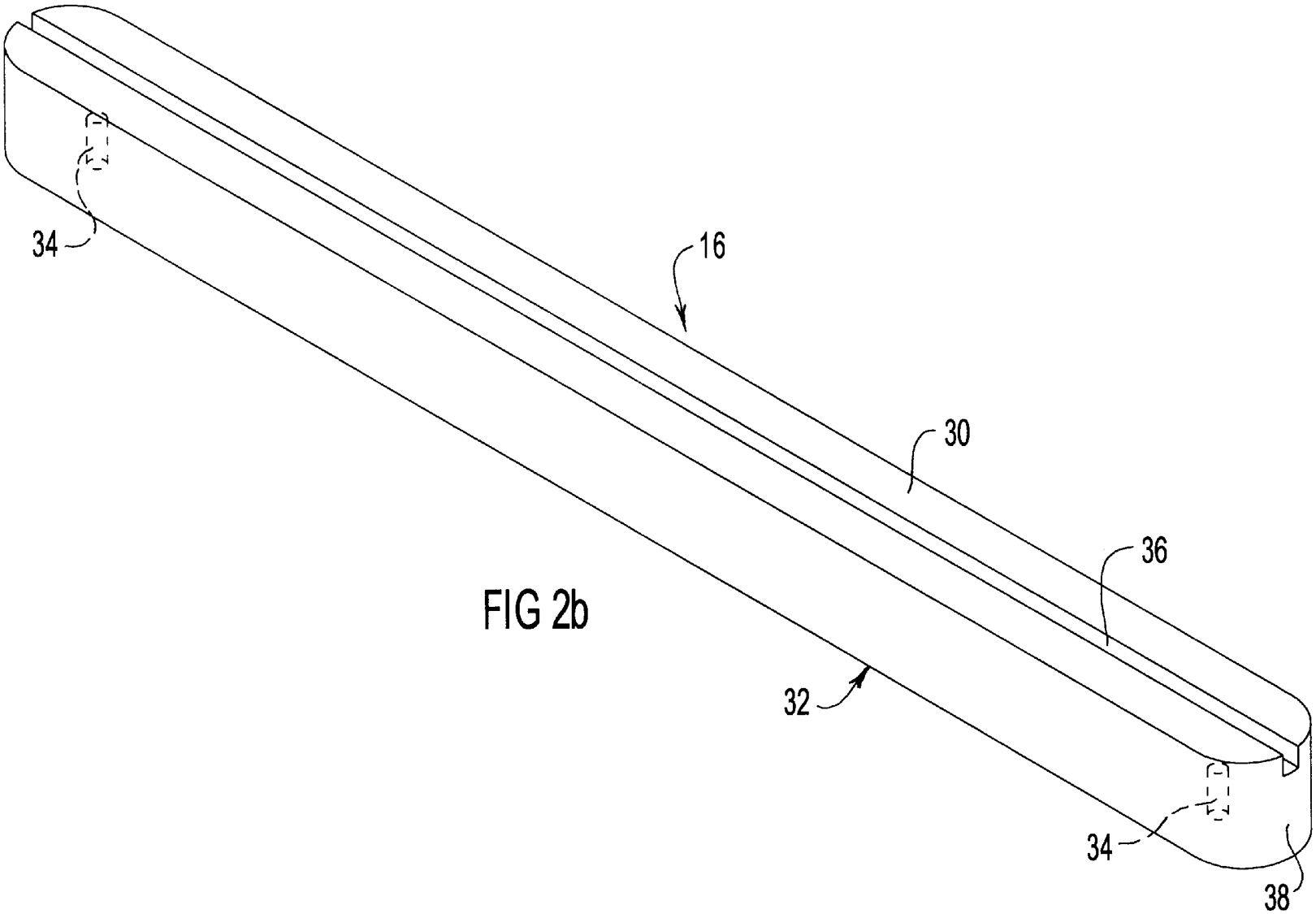
FIG. 2*b* is a perspective view of a bearer member for use with the embodiment of FIG. 1.

A preferred form of bearer 16 for use with the decking system 10 of the present invention is shown in FIG. 2*b*. The bearer 16 includes an upper surface 30 and a lower surface 32. The lower surface 32 includes respective openings 34 in the form of holes or slots that are capable of receiving the leg portion of the pivotable locating member discussed below. In the upper surface 30 of the bearer 16 is a trench 36 that extends along the full longitudinal extent thereof. The trench 36 is sized so as to be capable of receiving one end of the locating pins used to locate and constrain the treads thereon.

As will be evident from FIG. 2*b*, the ends 38 of the bearer member 16 are preferably curved so as to allow for a number of bearers to be placed on the upper surfaces of the stumps 18.

Figure 2C:
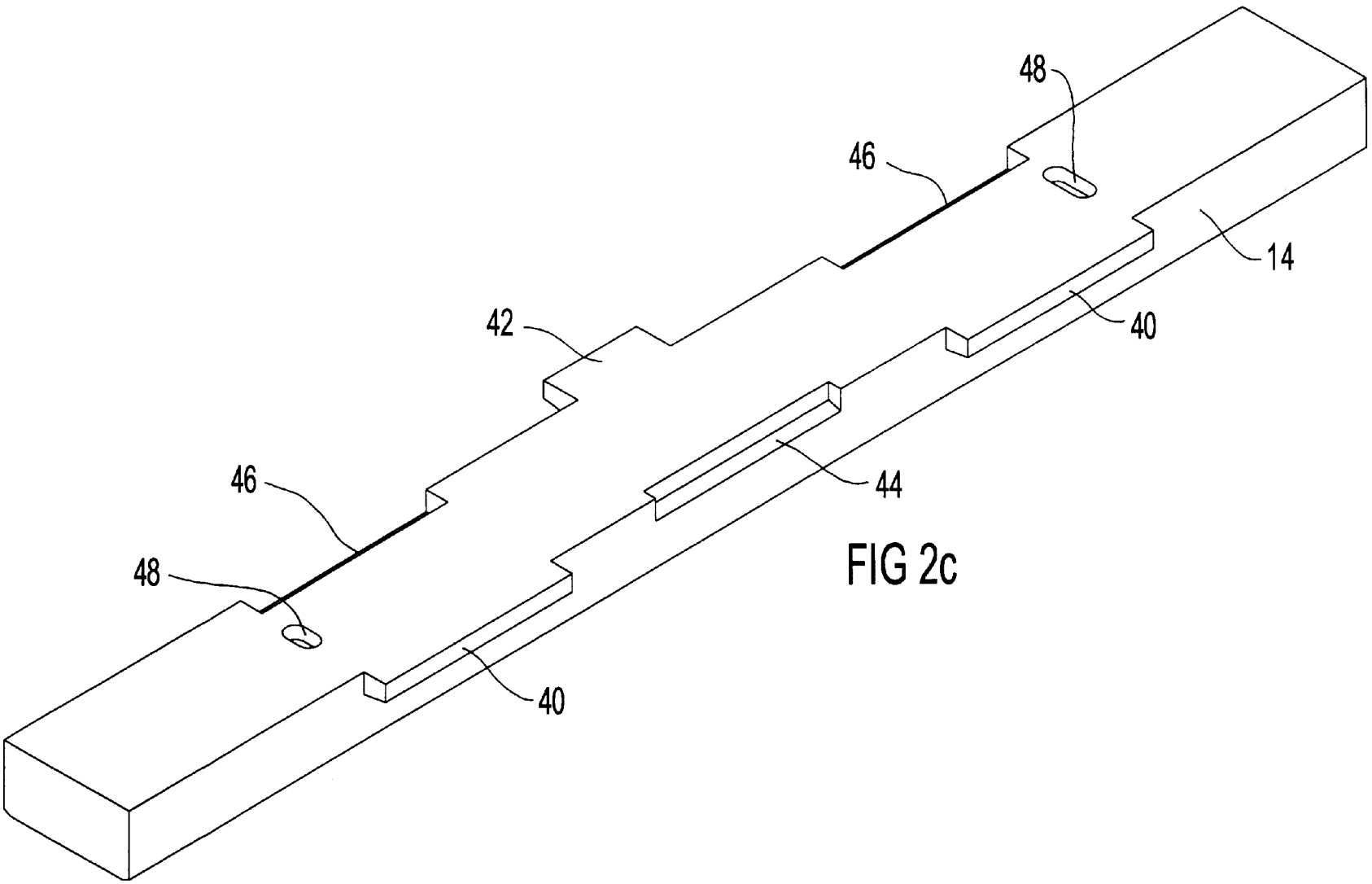
FIG. 2*c* is a perspective view of a tread for use with the embodiment of FIG. 1.

Illustrated in FIG. 2*c* is a tread 14 viewed from underneath in order to properly show the male and female mating members. In this respect, the tread 14 is shown having two male members 40 located towards the lower portion thereof on one side, and a further male member 42 also located at the lower portion thereof but on the other side. Corresponding female members 44 and 46 are similarly provided. Thus, by providing a plurality of similarly configured treads, the treads may be abutted in side-by-side relationship in a tongue and groove type mating position. In this way, once a tread is in place between two adjacent treads, the central tread is not able to be lifted and is readily secured.

Additionally, the presence of the locating pins in the openings 48 in the tread 14, when engaged with the trench 36 of the bearer 16, serves to prevent the central tread from being slidably removed from between its adjacent treads.

It will again be seen that by providing the treads in a material such as concrete, the dead weight of the treads assists in ensuring the stability of treads.

At this point, it should be noted that concrete provides additional advantages in that the upper portion of the treads may easily be provided with textures in order to improve the aesthetics of the decking system, or for instance in order to reduce slipperiness. Additionally, concrete readily accepts colouring and thus the treads may be provided in suitable shades.

Figure 3:
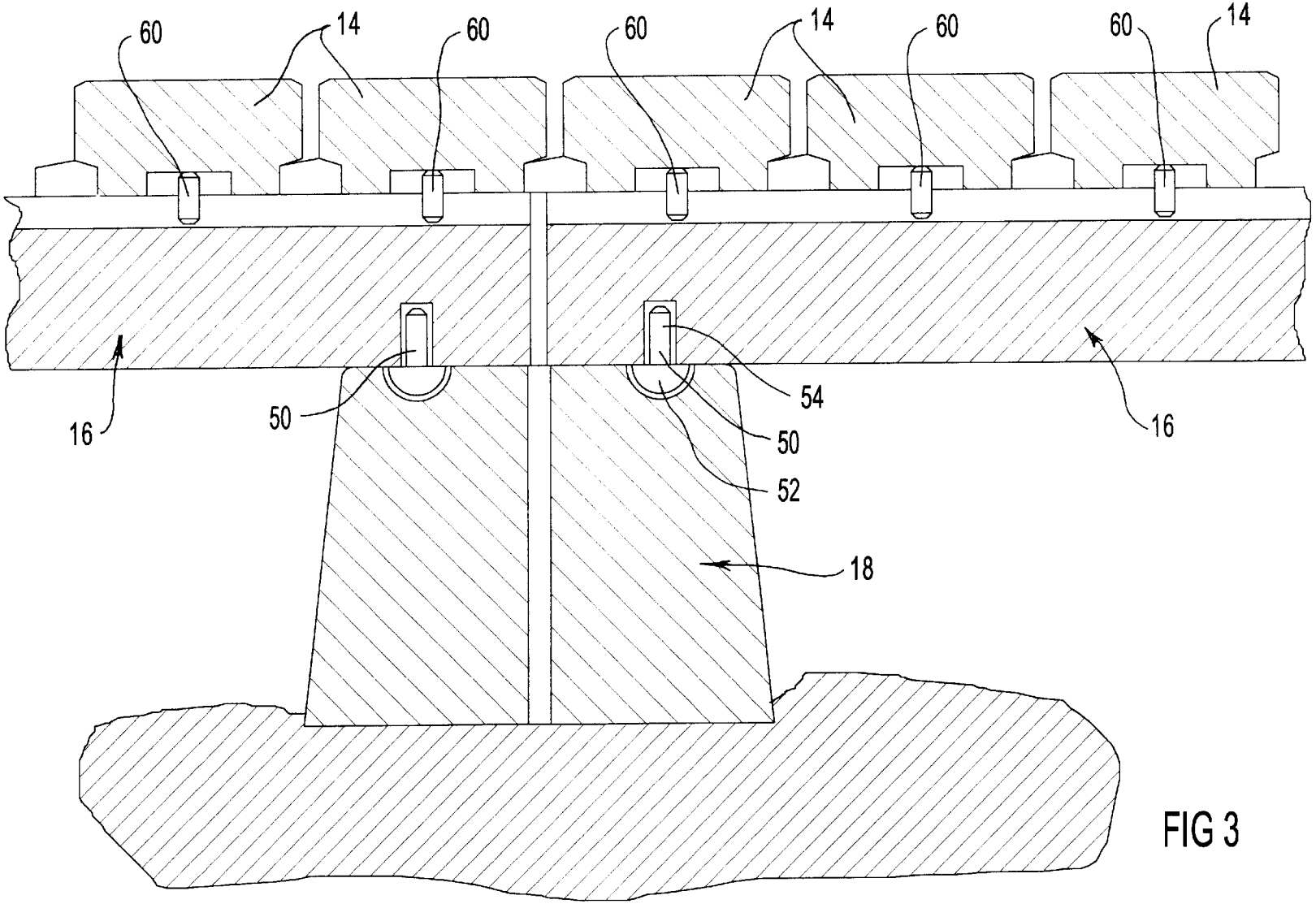
FIG. 3 is a schematic section of a connection between the stump, bearer member and tread of FIGS. 2*a* , 2*b* and 2*c* respectively, when used in the embodiment of FIG. 1.

FIG. 3 illustrates the three major components in use. Thus, illustrated is a stump 18 which is supporting respective ends of bearers 16 which are in turn carrying a decking in the form of treads 14. A bearer locating system is utilised, the bearer locating system being in the form of a pivotable locating member 50 of a generally mushroom shape, and have a semi-spherical head portion 52 and a leg portion 54 extending away therefrom. The location of the pivotable locating member 50 is such that the head portion is received in a semi-spherical socket in the upper surface of the stump, and the leg portion is received in a correspondingly shaped opening in the lower surface of the bearer member, in order to provide the free coupling referred to above.

This free coupling allows the bearer to be raised or lowered in relation to the stump (in the illustration of FIG. 3 this corresponds to the right hand end of the right bearer 16 being moved up or down the page). Alternatively, a bearer member 16 may be adjusted such that it rotates about the pivotable locating member (in the illustration of FIG. 3, the right hand bearer would thus move at its right hand end into and out of the page). Such adjustment is able to be made during construction, such as when the bearer member is first placed on the stump and is located at its other end at the next stump therealong.

FIG. 3 also illustrates a tread locating system that is provided for the engagement of the bearers 16 with the treads 14. The tread locating system is in the form of a locating pin 60 which is captured at one end thereof in the trench of the bearer 16, and at the other end thereof in a hole or slot in the lower surface of a tread 14. Again, the presence of a trench (or at least an oversized hole or slot in the upper surface of the bearer member) together with the hole or slot in the lower surface of the tread, allows for a degree of adjustment once treads are placed on bearers.

Finally, FIG. 3 additionally illustrates the use of a tread interlocking system provided in the form of the male and female members referred to earlier. In this respect, the male and female members are shown to be of a size such that the male member is oversized to act additionally as a spacer to provide a space between adjacent treads.

Figure 4:
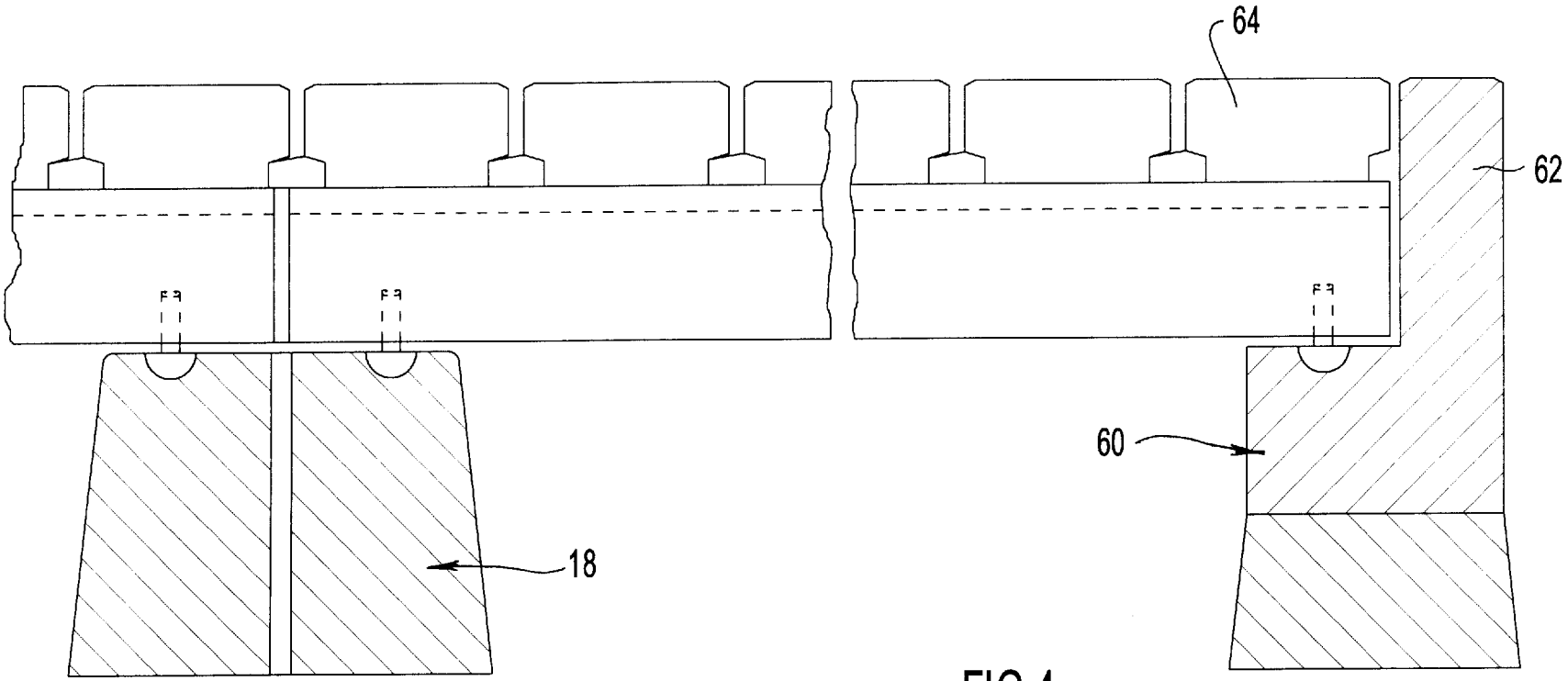
FIG. 4 is a schematic section view of an end of the embodiment of FIG. 1.

The illustration in FIG. 4 is provided to show a possible end arrangement for the decking system of the present invention. In this respect, it can be seen that the end stump 60 is of a different form to the previously described stump 18. The end stump 60 includes an upwardly projecting abutment 62 against which the final tread 64 may be placed. If required, the upper portion of the abutment 62 may additionally be pinned or otherwise secured directly to the final tread 64.

In every other respect, the end stump 60 is functionally the same as the described stump 18, particularly with regard to the use of a pivotable locating member in the form of a generally mushroom shaped pin.

Figure 5:
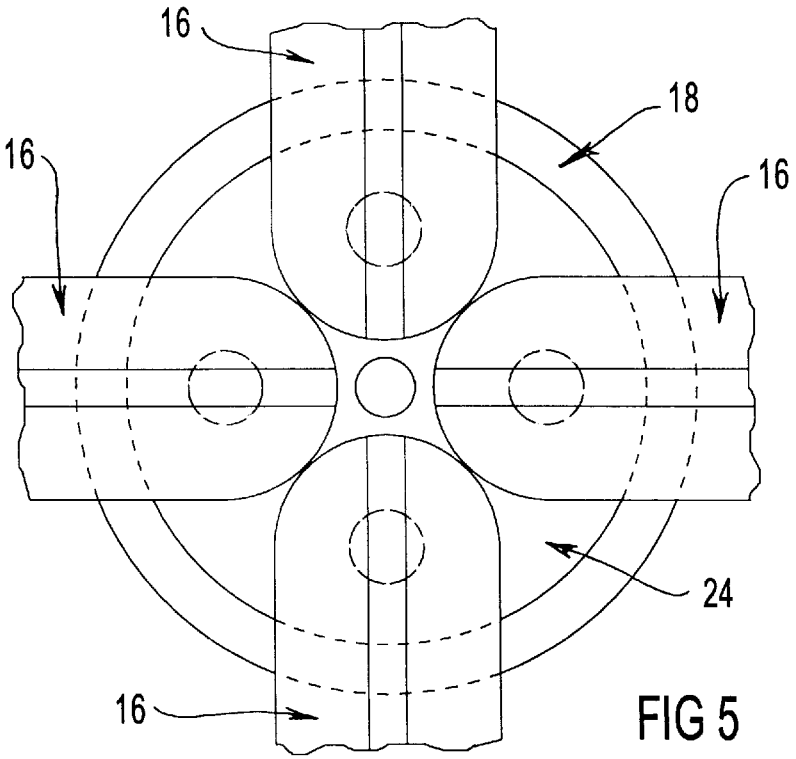
FIG. 5 is a plan view of a stump carrying four bearer members in an envisaged alternative arrangement.

In the final figure, FIG. 5, an arrangement is illustrated which shows that a stump 18 may support more than one bearer 16. Indeed, depending on the size of the upper surface of the stump 18, and the number of sockets provided which may receive the semi-spherical head portion of the pivotable locating member, a stump may support any number of bearers. Thus, it can be seen that a line of stumps may be provided down each side of a path such as that illustrated in FIG. 1, only needing to carry longitudinally aligned bearers. Alternatively, and most likely where a platform or other such structure is required to be constructed, a stump may located centrally under the structure and may be such that it carries three or more such bearers.

In conclusion, it must be appreciated that there may be other various and modifications to the configurations described herein which are also within the scope of the present invention.

We claim:

1. An improved modular decking system, the system including decking in the form of a plurality of treads, the decking being carried by one or more bearer members, and the bearer members in turn being supported at or above ground level by one or more stumps, wherein engagement between the bearer members and the stumps is via a bearer locating system which includes a pivotable locating member which provides a free coupling between a bearer member and its supporting stump, and a tread locating system which provides engagement between the bearer members and the treads carried thereon, said tread locating system including a locating pin received in the upper surface of a bearer member and the lower surface of a tread to locate the tread on the bearer member in a predetermined position.

2. A system according to claim 1 wherein the pivotable locating member is of a mushroom-type shape, having a semi-spherical head portion and a leg portion extending away from the head portion.

3. A system according to claim 2 wherein the semi-spherical head portion of the pivotable locating member is received, inverted, in a hole provided in the upper surface of the stump, the hole having a semi-spherical configuration and being sized so as to snugly receive the semi-spherical head portion of the pivotable locating member.

4. A system according to claim 3 wherein the bearer member includes a slot or a hole in its lower surface receiving the leg portion of the pivotable locating member therein, the slot or hole being of a size larger than the size of the leg portion such that the leg portion is loosely received therein.

5. A system according to claim 1 wherein the upper surface of the bearer member has a hole or slot therein which receives one end of the locating pin and the lower surface of a tread similarly includes a hole or a slot receiving the other end of the locating pin therein, the holes or slots in the upper surface of the bearer member and the lower surface of the treads being sized in relation to the locating pin so as to allow some movement of the treads in relation to the bearer members.

6. A system according to claim 1 wherein the bearer member is elongated and has a length dimension, and the upper surface of the bearer member includes a trench along the full extent of said length dimension of the bearer member.

7. A system according to claim 1, wherein said bearer and said treads are elongated and have length dimensions, said treads being arranged on said bearer member adjacent to one another alone the length dimension of the bearer member with said length dimensions of said treads generally perpendicular to the length dimension of the bearer member, and including a tread interlocking system which provides engagement between adjacent ones of the treads, the tread interlocking system including respective male and female members on adjacent ones of the treads to mate the adjacent ones of the treads.

8. A system according to claim 7 wherein the male and female members are of the tongue and groove type.

9. A system according to claim 7 wherein the male member is slightly oversized so as to act both as a mating member and a spacing member.

10. A system according claim 1, wherein the stumps have broad bases.

11. A system according to claim 10 wherein the stumps have a central aperture completely therethrough (from top to bottom) for receiving a stake or spike to pin the stump to the ground.

12. An improved modular decking system, the system including decking in the form of a plurality of elongated treads having a length dimension and elongated sides parallel to the length dimension, the treads being arranged elongated side by elongated side adjacent to one another, the decking being carried by one or more bearer members, the bearer members in turn being supported at or above ground level by one or more stumps, wherein engagement between bearer members and stumps is via a bearer locating system which includes a pivotable locating member providing a free coupling between a bearer member and its supporting stump, and wherein a tread locating system is provided for engagement of bearer members with treads, the tread locating system including a locating pin locating the tread on the bearer member in a predetermined position along the length dimension of the tread, and wherein a tread interlocking system is provided for engagement of adjacent ones of the treads, the tread interlocking system including respective male and female members on adjacent ones of the treads to mate the adjacent ones of the treads.

13. A system according to claim 12 wherein the stumps have broad bases.

14. A system according to claim 13 wherein the stumps have a central aperture completely therethrough (from top to bottom) for receiving a stake or spike to pin the stump to the ground.

* * * * *